US005511611A

United States Patent [19]

Nishishita

[11] Patent Number: 5,511,611

[45] Date of Patent: Apr. 30, 1996

[54] HEAT EXCHANGER

[75] Inventor: Kunihiko Nishishita, Konan, Japan

[73] Assignee: Zexel Corporation, Tokyo, Japan

[21] Appl. No.: 413,408

[22] Filed: Mar. 30, 1995

[30] Foreign Application Priority Data

Mar. 31, 1994 [JP] Japan ..... 6-085509

[51] Int. Cl.[6] ..... F28D 1/03

[52] U.S. Cl. ..... 165/153; 165/176; 165/DIG. 466

[58] Field of Search ..... 165/153, 176

[56] References Cited

U.S. PATENT DOCUMENTS 4,621,685 11/1986 Nozawa ..... 165/111
5,042,577 8/1991 Suzumura ..... 165/153
5,295,532 3/1994 Hughes ..... 165/76

*Primary Examiner*—Allen J. Flanigan
*Attorney, Agent, or Firm*—Wenderoth, Lind & Ponack

[57] ABSTRACT

A heat exchanger structured with a plurality of tube elements laminated alternately with fins over a plurality of levels and end plates at either end in the direction of lamination. A passage plate, in which a supply passage and a discharge passage for heat exchanging medium are formed, is provided on the side of one of the end plates, and an intake pipe and an outlet pipe for heat exchanging medium are connected to the supply passage, and the discharge passage respectively, of the passage plate. The supply passage and the discharge passage of the passage plate have sufficient length, to allow the intake pipe and the outlet pipe to be connected at arbitrary positions. It is possible to connect the intake pipe and the outlet pipe for heat exchanging medium at arbitrary positions for different types of vehicles. Also, a heat exchanger in which commonality of components is achieved.

5 Claims, 6 Drawing Sheets

HEAT EXCHANGER

BACKGROUND OF THE INVENTION

1. Field of the Invention

The present invention relates to a heat exchanger primarily for use in air conditioning systems for vehicles.

2. Description of the Related Art

The heat exchangers that have been developed by this inventor have a structure in which, as shown in FIGS. 9 and 10, for instance, a plurality of tube elements 1 are laminated alternately with fins 2 over a plurality of levels, and have end plates 3 and 4 provided at either end in the direction of the lamination. A passage plate 7, in which a supply passage 5 and a discharge passage 6 for the heat exchanging medium are formed, is provided at the side of one of the end plates, i.e., the end plate 3. An intake pipe 8 and an outlet pipe 19 for the heat exchanging medium are connected to the upper ends of the supply passage 5 and the discharge passage 6, respectively, of the passage plate 7.

However, with this type of heat exchanger, in which the intake pipe and the outlet pipe for the heat exchanging medium are connected to the upper ends of the supply passage and the discharge passage of the passage plate, respectively, if the positions at which the intake pipe and the outlet pipe are connected must be changed to suit the design arrangement of the vehicle, it is necessary that the plate be formed so as to correspond to the height of the connections required by the particular vehicle.

In other words, to be used with different vehicles the positions at which the intake pipe and the outlet pipe are connected (heights) must conform to the requirements of specific vehicles with their particular design arrangements. In such a case, with the type of heat exchanger in which the intake pipe and the outlet pipe for the heat exchanging medium are connected to the upper ends of the supply passage and the discharge passage of the passage plate, respectively, a plate must be provided which corresponds to the positions of the intake pipe and the outlet pipe (heights) which are required for each vehicle. This means that common components cannot be used, presenting problems in cost and in assembly.

SUMMARY OF THE INVENTION

Accordingly, the object of the present invention is to provide a heat exchanger with which it is possible to connect the intake pipe and the outlet pipe for heat exchanging medium at any given position and to achieve commonality of components, by addressing the problems described above.

In order to achieve the object described above, the heat exchanger according to the present invention is a heat exchanger constituted by laminating a plurality of tube elements alternately with fins over a plurality of levels and providing end plates at either end in the direction of the lamination, a passage plate at the side of one of the end plates, in which a supply passage and a discharge passage for the heat exchanging medium are formed, and by connecting an intake pipe and an outlet pipe for the heat exchanging medium to the supply passage and the discharge passage of the passage plate, respectively, in which the lengths of the supply passage and the discharge passage are extended upwards to the maximum possible limit, allowing the intake pipe and the outlet pipe to be connected at arbitrary heights.

In the present invention, partitioning plates may be provided in the middle of the supply passage and the discharge passage of the passage plate to which the intake pipe and the outlet pipe are connected so that the excess spaces above the connection can be blocked off.

As a result, since the lengths of the supply passage and the discharge passage of the passage plate are extended upwards in the heat exchanger according to the present invention, it is possible to connect the intake pipe and the outlet pipe at any arbitrary position along the course of those passages.

Additionally, the excess spaces which are present above the connecting areas of the intake pipe and the outlet pipe located at arbitrary positions in the extended supply passage and discharge passage of the passage plate, are closed off with partitioning plates to prevent the heat exchanging medium from collecting in these excess spaces and becoming stagnant.

BRIEF DESCRIPTION OF THE DRAWINGS

These and other advantages, features and objects of the present invention will be understood by those of ordinary skill in the art referring to the annexed drawings, given purely by way of non-limitative example, in which.

DETAILED DESCRIPTION OF THE PREFERRED EMBODIMENTS

The following is an explanation of the embodiments according to the present invention with reference to the drawings.

Figure 1:
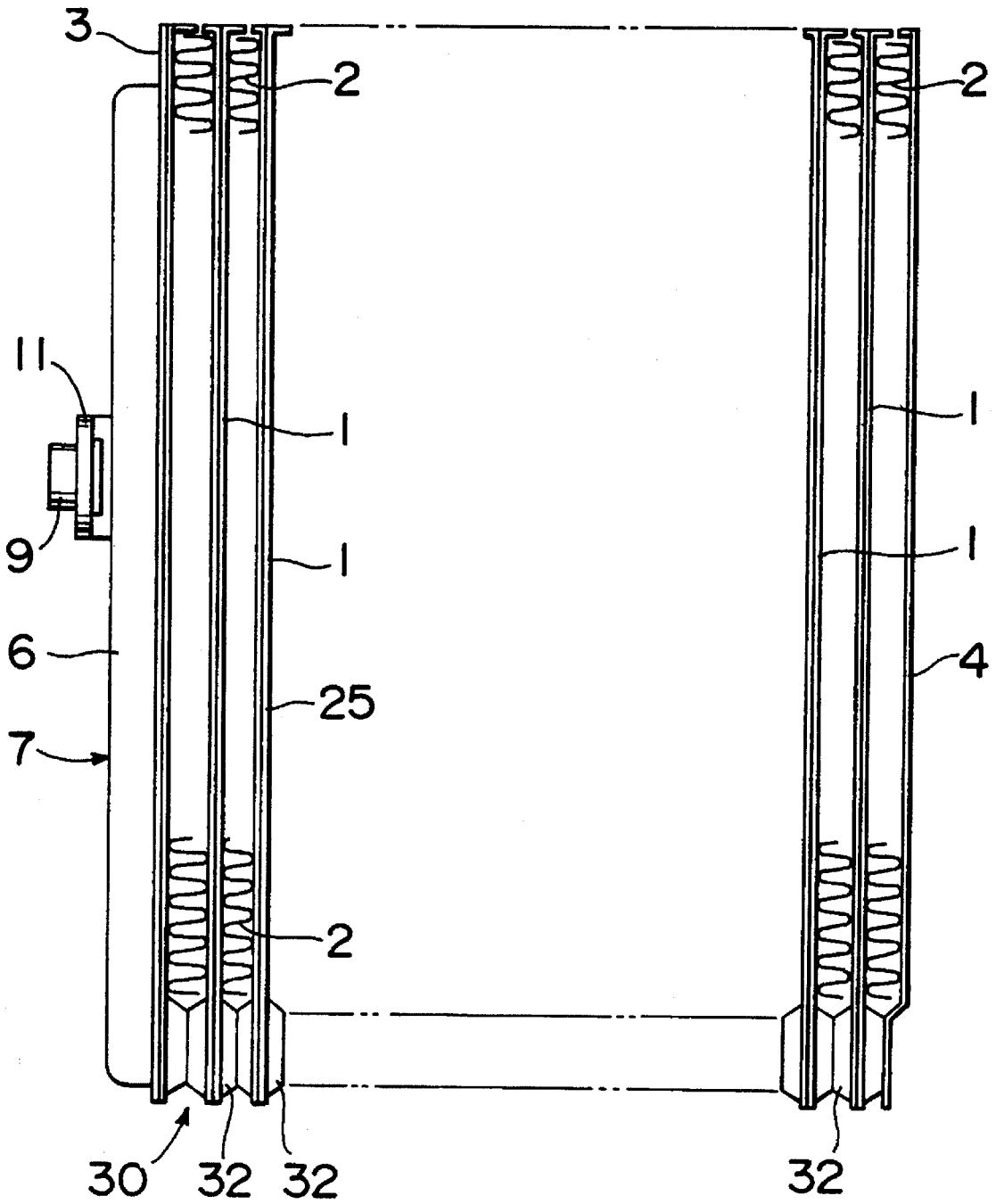
FIG. 1 is a schematic structural diagram of the heat exchanger according to the present invention.
Figure 2:
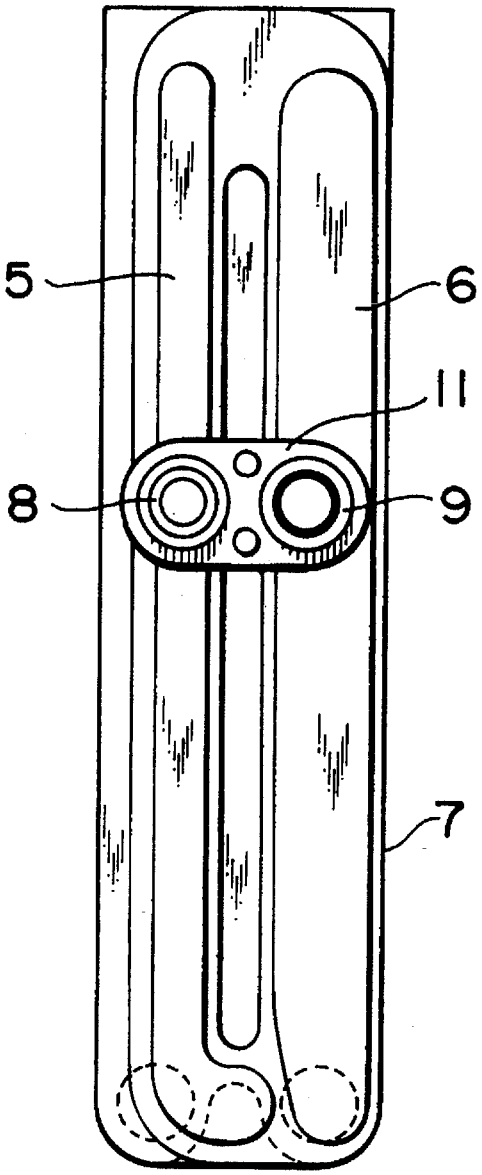
FIG. 2 is a side view of the heat exchanger of FIG. 1.

FIGS. 1 and 2 show an example of a so-called 4-pass heat exchanger.

The heat exchanger is structured with a plurality of tube elements 1 laminated alternately with fins 2 over a plurality of levels. End plates 3 and 4 are provided at either end in the direction of the lamination. A passage plate 7, in which a supply passage 5 and a discharge passage 6 for the heat exchanging medium are formed, is provided at the side of one of the end plates, i.e., the end plate 3, and an intake pipe 8 and an outlet pipe 9 for the heat exchanging medium are connected to the supply passage 5 and the discharge passage 6, respectively, of the passage plate 7. Note that reference number 11 indicates a mounting plate for connecting the intake pipe 8 and the outlet pipe 9 to an expansion valve 37 which is to be explained later.

Figure 3:
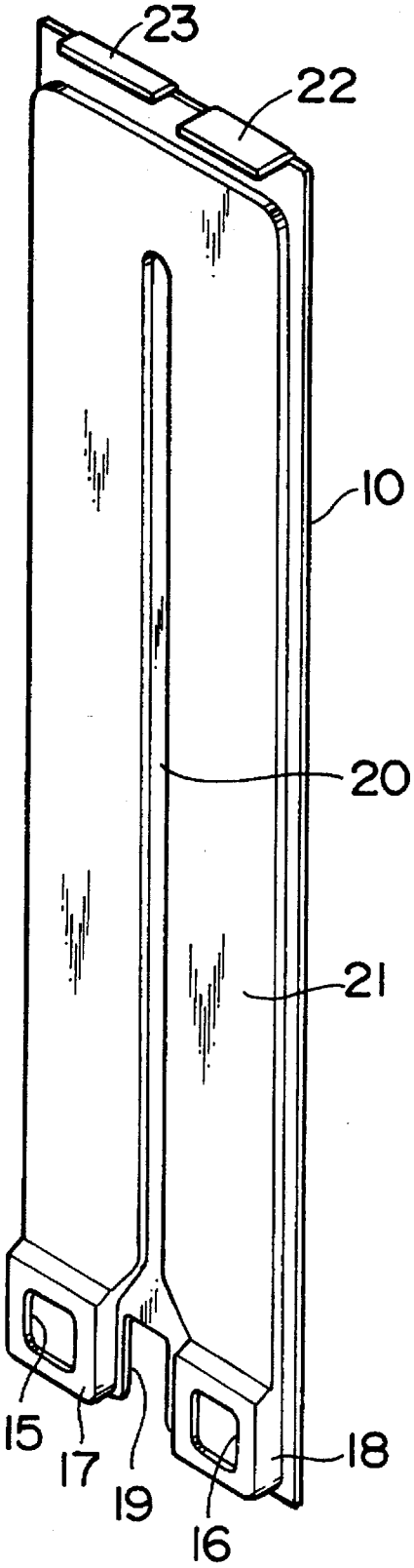
FIG. 3 is a perspective of a formed plate which constitutes a tube element.

A tube element 1 is constituted by bonding two formed plates 10, shown in FIG. 3, flush to each other. The formed plate 10 is shaped rectangularly and toward one end in the direction of its length, a pair of indented portions for tank formation 17, 18 are formed by distension. The indented portions for tank formation 17, 18, have communicating holes 15, 16 respectively bored through them and a notch 19, for fitting a heat exchanging medium supply pipe 88, to be explained later, between them. Also, a projection 20 is formed by projecting out above the notch 19 extending toward the other end. Around the projection 20, an approximately U-shaped indented portion for heat exchanging medium passage formation 21, which communicates with the indented portions for tank formation 17, 18, is formed by distension.

In addition, towards the other end in the direction of the length of the formed plate 10, a pair of fin-holding portions 22, 23 for holding the fins 2 are formed bent towards the outside at a specific length.

In each tube element 1 that is constituted by bonding two such formed plates 10 flush to each other, a pair of tank portions 32, 32 are constituted with the indented portions for tank formation 17, 18 which face opposite each other at one end. Inside the tube element, a heat exchanging medium passage 25, which is approximately U-shaped, is constituted with the indented portions for heat exchanging medium passage formation 21 which face opposite each other. This heat exchanging medium passage 25 communicates with the tank portions 32, 32.

Figure 4:
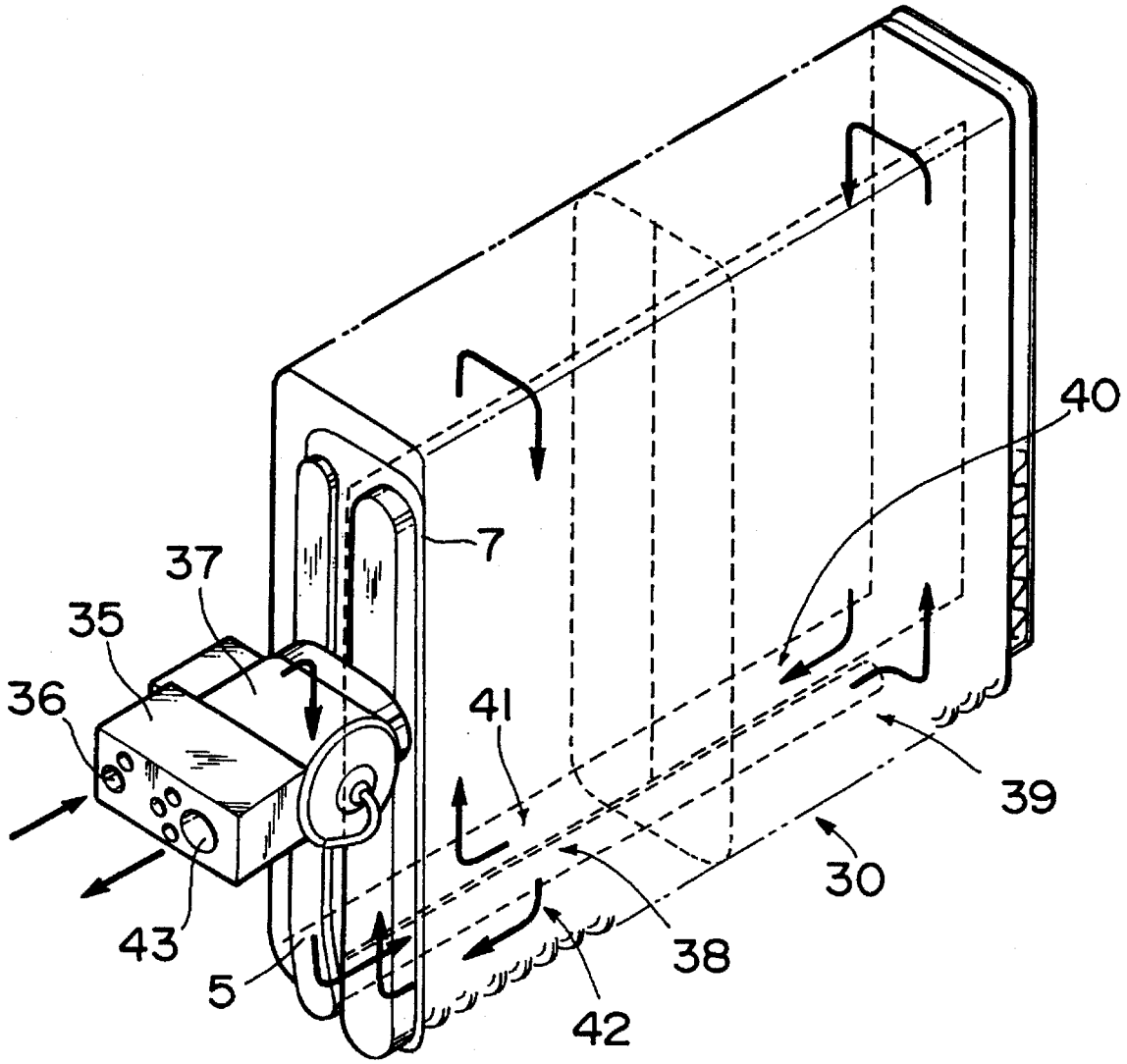
FIG. 4 is a typical functional diagram which illustrates the flow of the heat exchanging medium.

By laminating the tube elements 1 while the tank portions 32, 32 in adjoining tube elements are bonded, a heat exchanger core with a single tank structure is constituted, in which a tank group 30 is formed at the bottom. At the side of this core, the passage plate 7 is provided, to which the intake pipe 8 and the outlet pipe 9 are connected. Note that the tank group 30 is formed over two rows running parallel to each other in the direction of the lamination, as shown in FIG. 4, and the tank group in one of the rows is partitioned at approximately the center, to be divided into two tank passages, 39, 42. However, the tank group in the other row does not have a partition and constitutes tank passages 40, 41 which communicate with each other.

The supply passage 5 in the passage plate 7 communicates with the tank passage 39 via the heat exchanging medium supply pipe 38 while the discharge passage 6 communicates with the tank passage 42.

The heat exchanger structured as described above has the so-called 4-pass flow pattern, as shown in FIG. 4. The heat exchanging medium, which is supplied to the supply passage 5 of the passage plate 7 from a heat exchanging medium intake 36 in a coupler 35 via a block-type expansion valve 37, flows through the heat exchanging medium supply pipe 38, which is connected to the supply passage 5 and then travels to the tank passage 39 constituted of the tank portions 32. The heat exchanging medium then flows through the heat exchanging medium passage 25 of each tube element from the tank passage 39, which communicates with the heat exchanging medium passage, to reach the tank passage 40. At this point, it moves horizontally through the tank passage 40 to travel to the tank passage 41, from which it flows through the heat exchanging medium passage 25 of each tube element that communicates with the tank passage 41. As the heat exchanging medium flows through the tube elements, heat exchange is performed with the outside air and finally, it is returned via the tank passage 42. The heat exchanging medium collected in the tank passage 42 is discharged via the discharge passage 6 of the passage plate 7 to the heat exchanging medium outlet 43 in the coupler 35 of the block type expansion valve via the expansion valve 37.

It should be noted that the supply passage 5 and the discharge passage 6 of the passage plate 7 are extended upward compared to those in the prior art, as shown in FIGS. 1 and 2, so that the intake pipe 8 and the outlet pipe 9 can be mounted anywhere along those passages.

In other words, the lengths of the supply passage 5 and the discharge passage 6 of the passage plate 7 are extended in the upward direction so that the intake pipe 8 and the outlet pipe 9 can be connected at arbitrary heights and the mounting positions (heights) of the intake pipe 8 and the outlet pipe 9 can be varied to accommodate various types of vehicles. This makes it possible to connect the intake pipe 8 and the outlet pipe 9 to the passage plate 7 at any height so the passage plate 7 itself can be used as a common component.

Figure 5:
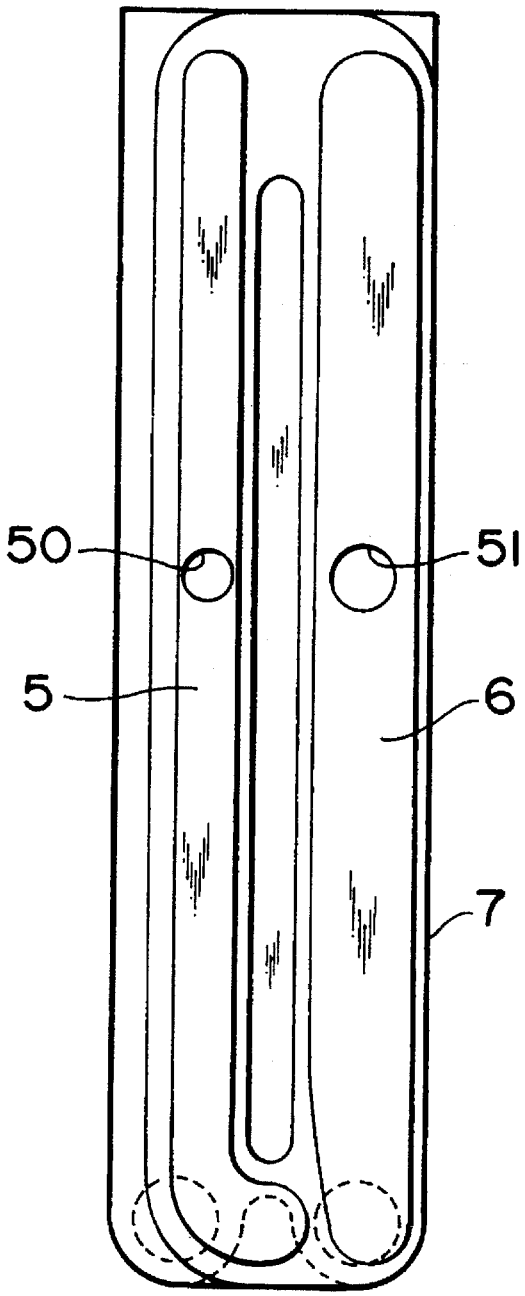
FIGS. 5 and 6 show examples of mounting positions of the intake pipe and the outlet pipe.
Figure 6:
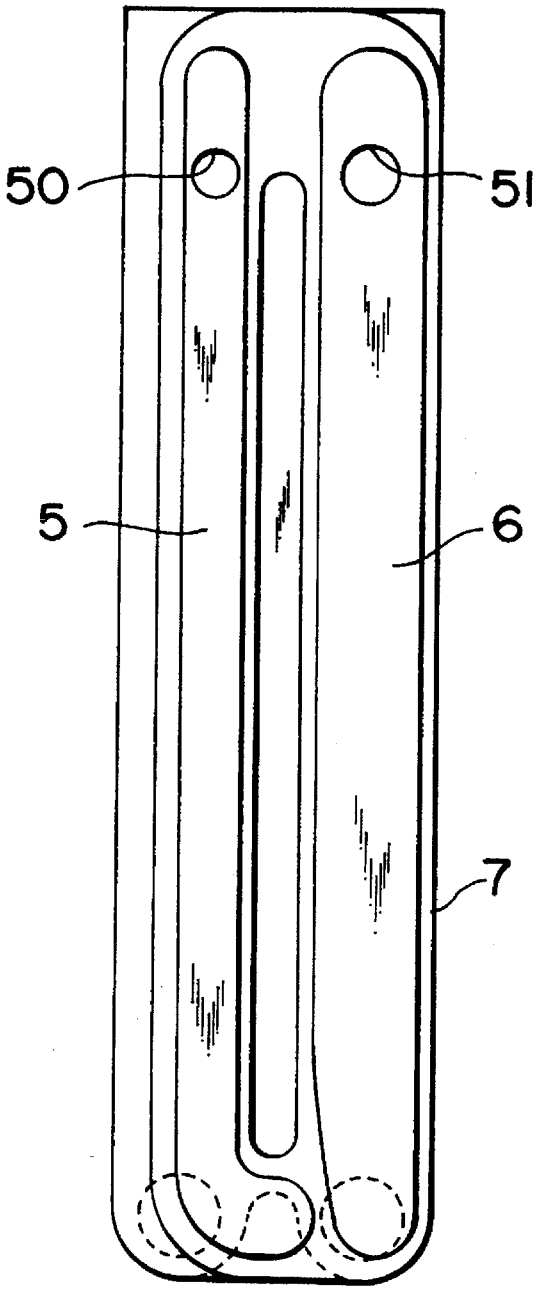

In short, as shown in FIGS. 5 and 6, the intake pipe 8 and the outlet pipe 9 have only to be connected to connecting holes 50, 51 for connecting the intake pipe 8 and the outlet pipe 9 which are bored at arbitrary positions in the extended supply passage 5 and discharge passage of the passage plate 7.

Consequently, the intake pipe 8 and the outlet pipe 9 can be connected at arbitrary positions, without requiring the shape of the passage plate 7 to be changed, thereby requiring that only one type of plate be manufactured.

Figure 7:
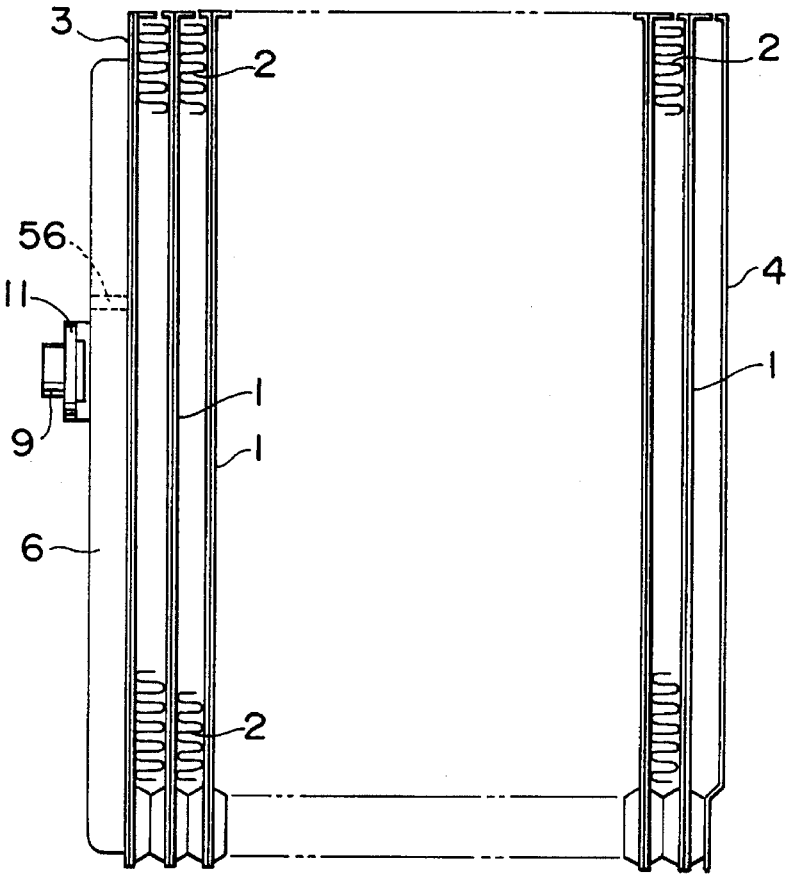
FIGS. 7 and 8 are schematic structural diagrams of a front and a side view of the heat exchanger in a second embodiment according to the present invention.
Figure 8:
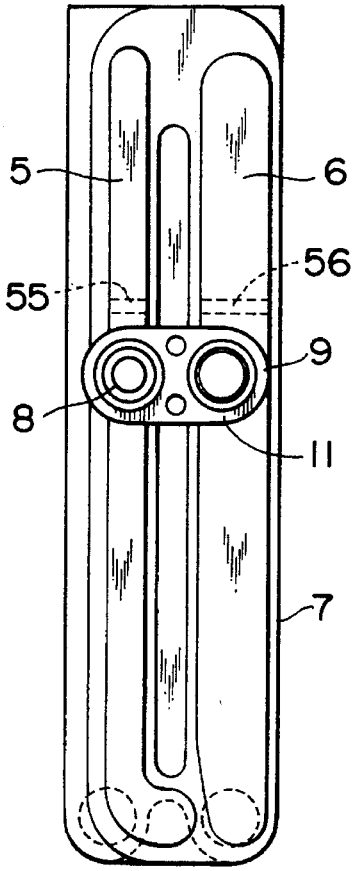
Figure 9:
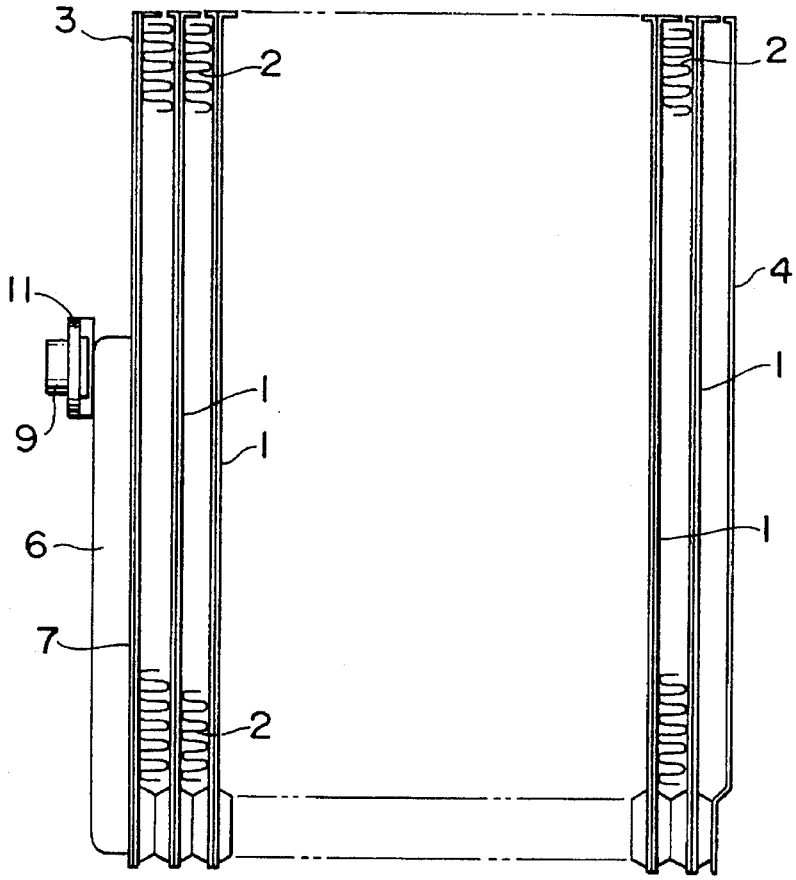
FIGS. 9 and 10 are a schematic structural diagram and a side view of a heat exchanger in the prior art.
Figure 10:
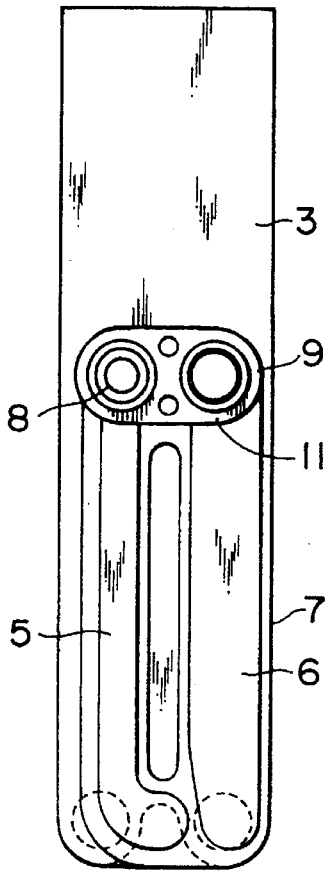

Next, another embodiment of the heat exchanger according to the present invention is explained with reference to FIGS. 7 and 8.

This embodiment differs from the first embodiment in that the excess spaces in the extended supply passage 5 and discharge passage 6 of the passage plate 7 are blocked off with the partitioning plates 55, 56. All other aspects of the structure are identical to those in the first embodiment according to the present invention, which has been explained above, and this further explanation is omitted here. The same reference numbers are assigned to parts corresponding to those in the first embodiment.

In order to block off the excess spaces in the supply passage 5 and discharge passage 6, the partitioning plates 55, 56 are provided in the middle of the supply passage 5 and the discharge passage 6, respectively, at positions that are higher than the positions at which the intake pipe 8 and the outlet pipe are connected.

In other words, without the partitioning plates 55, 56 provided inside the supply passage 5 and the discharge passage 6, a portion of the heat exchanging medium flowing through the supply passage 6 and the discharge passage 6 would be retained in those excess spaces and would become idle, likely reducing the performance of the heat exchanger. In order to prevent this, the partitioning plates 55, 56 block off these excess spaces to ensure that the heat exchanging medium flows efficiently, maintaining the performance level.

Note that when connecting the intake pipe 8 and the outlet pipe 9 towards the uppermost end of the extended supply passage 5 and discharge passage 6 of the passage plate 7, there is no resulting excess space. This situation, therefore, will preclude the necessity of providing partitioning plates 55, 56.

In summary, the partitioning plates 55, 56 block off the excess spaces created when connecting the intake pipe 8 and the outlet pipe 9 to the middle of the extended supply passage 5 and discharge passage 6 of the passage plate 7 to prevent the heat exchanging medium from becoming idle in the excess spaces and to prevent a reduction in performance of the heat exchanger.

As has been explained, with the heat exchanger according to the present invention, since the lengths of the supply passage and the discharge passage of the passage plate are extended in the upward direction to the maximum limit, which thereby allows the intake pipe and the output pipe to be connected at arbitrary heights, it becomes possible to connect the intake pipe and the outlet pipe at arbitrary positions using a single passage plate design, and precluding the necessity of changing the shape of the passage plate. As a result, it is not necessary to form different passage plates to suit different vehicles, and this achieves a reduction in the cost of parts and an improvement in ease of assembly.

Moreover, since the excess spaces created when putting together the heat exchanger in the extended supply passage and discharge passage of the passage plate as described above are blocked off with partitioning plates, it is possible to prevent the heat exchanging medium from becoming idle and to prevent a reduction in the performance of the heat exchanger and, at the same time, it becomes possible to reduce the quantity of heat exchanging medium required to fill the heat exchanger.

What is claimed is;

1. A heat exchanger comprising:

a plurality of tube elements laminated alternately with fins over a plurality of levels:

end plates provided at either end in the direction of lamination;

a passage plate at the side of one of said end plates, in which a supply passage and discharge passage for heat exchanging medium are formed;

an intake pipe and an outlet pipe connected to said supply passage and said discharge passage, respectively, of said passage plate;

wherein said supply passage and said discharge passage of said passage plate have sufficient lengths to allow said intake pipe and said outlet pipe to be connected at arbitrary positions;

wherein tube elements, each of which is provided with a pair of tanks on one side and also with a U-shaped heat exchanging medium passage communicating between said pair of tanks, are laminated alternately with fins over a plurality of levels;

wherein tanks in adjoining tube elements are interconnected to form two tank groups extending in the direction of said lamination, one of said tank groups having a partition at approximately a center thereof such that said one of said tank groups is divided into two portions, the other of said tank groups having no partition:

wherein said supply passage communicates via a heat exchanging medium supply pipe with one of said portions in said one of said tank groups, said one of said portions being further away than the other of said portions from said passage plate, and said discharge passage communicating with the other of said portions of said one of said tank groups; and wherein said heat exchanger has a so-called 4-pass flow pattern with tanks only on one side, in which, said heat exchanging medium is supplied to said heat exchanging medium supply pipe from said supply passage to enter approximately half of said tube elements, then enters the remaining tube elements after passing through said U-shaped heat exchanging medium passages of said tube elements and finally reaches said discharge passage after passing through the U-shaped heat exchanging medium passages of said remaining tube elements.

2. A heat exchanger according to claim 1, wherein said passage plate is approximately the same length as said end plates.

3. A heat exchanger according to claim 1, wherein said supply passage and said discharge passage are formed between said one of said end plates and said passage plate, and said passage plate is bonded to said one of said end plates.

4. A heat exchanger according to claim 1, wherein each of said tube elements is formed by bonding two formed plates flush to each other along their edges.

5. A heat exchanger comprising:

a plurality of tube elements laminated alternately with fins over a plurality of levels;

end plates provided at either end in the direction of lamination;

a passage plate at the side of one of said end plates, in which a supply passage and a discharge passage for heat exchanging medium are formed;

an intake pipe and an outlet pipe connected to said supply passage and said discharge passage, respectively, of said passage plate;

wherein said supply passage and said discharge passage of said passage plate have sufficient lengths to allow said intake pipe and said outlet pipe to be connected at arbitrary positions: and wherein partitioning plates are provided in said supply passage and said discharge passage of said passage plate in order to block off excess spaces created above the connecting positions of said intake pipe and said outlet pipe.

* * * * *